United States Patent [19]

Wilson

[11] 4,170,216

[45] Oct. 9, 1979

[54] BOWSTRING RELEASE MECHANISM

[76] Inventor: Hugh R. Wilson, 10840 SW. 120th St., Miami, Fla. 33176

[21] Appl. No.: 868,413

[22] Filed: Jan. 10, 1978

[51] Int. Cl.[2] ..... F41B 5/00

[52] U.S. Cl. ..... 124/35 A

[58] Field of Search ..... 124/35 A, 24 R, 23 R, 124/90, 41 A

[56] References Cited

U.S. PATENT DOCUMENTS

| | | | |
|---|---|---|---|
| 3,009,454 | 11/1961 | Graham | 124/35 A |
| 3,937,206 | 2/1976 | Wilson | 124/90 X |
| 3,954,095 | 5/1976 | Lewis | 124/35 A |
| 3,998,202 | 12/1976 | Boyko | 124/35 A |
| 4,004,564 | 1/1977 | Castonguay | 124/35 A |

*Primary Examiner*—Richard C. Pinkham
*Assistant Examiner*—William R. Browne

[57] ABSTRACT

A bowstring release device for drawing and releasing a bowstring to propel an arrow to the target. The structure comprises a body, a wheel-like holding member and a wheel-like locking member. The holding member has a concave radius cut into its periphery that matches the periphery of the locking means. The locking means also has a radius cut into it's periphery that matches the periphery of the holding member. The two parts are very closely fitted on pivot pins so that the two parts are always in contact with each other. When the device is in a cocked position, the holding member is locked by the periphery of the locking member which extends into the radius cut into the periphery of the holding member. As the locking member is rotated to it's second position the forward edge of the radius cut into the periphery of the locking member emerges from the radius cut into the periphery of the holding member releasing the holding member and allowing the periphery of the holding member to enter the radius cut in the periphery of the locking member as the holding member rotates to release a bowstring.

4 Claims, 3 Drawing Figures

BOWSTRING RELEASE MECHANISM

FIELD OF THE INVENTION

The device is intended for use in archery target shooting and for bowhunting.

DESCRIPTION OF THE PRIOR ART

Although many bowstring release devices have appeared in the past, most of them have been based on mechanical principles that were previously used for other purposes. The novelty of this invention resides in the very simplicity of it's structure and in the uniqueness of it' design and function. The device comprises only two moving parts which always remain in contact with each other and never disengage. When the holding member which is circular in shape, is released by the locking member, it enters the radius cut into the periphery of the locking member and moves to release a bowstring. As the contacting surface of the holding member reaches the center point of the radius cut into the locking member it encounters an increasing friction due to the pressure held on the locking member by the user's finger. At this point the bowstring is emerging from the holding notch in the holding member and the braking effect of the increasing friction brings the holding member to a reduced velocity or stop before striking the stop surface in the body of the device. This produces a very quiet release action which is very desirable when hunting game with a bow.

SUMMARY OF THE INVENTION

It is an object of this invention to provide a new and novel bowstring release device that is reliable and cheap to manufacture.

Another object of this invention is to provide a new bowstring release device that is simple in construction and so sturdy that it will give many years of long hard service without failure or excessive wear.

A further object of this invention is to provide a new bowstring release device that will be quick to use and more silent in operation.

A BRIEF DESCRIPTION OF THE DRAWINGS

DESCRIPTION OF THE PREFERRED EMBODIMENT

Figure 1:
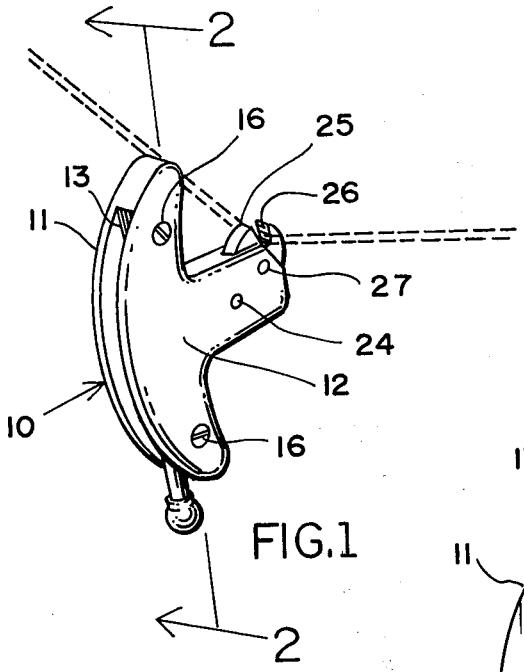
FIG. 1 shows the device attached to a bowstring with the bowstring shown in broken lines.
Figure 2:
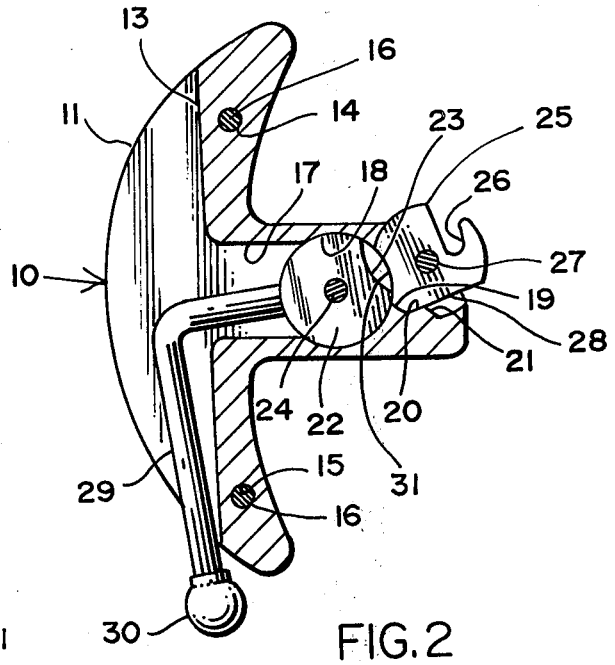
FIG. 2 shows the device in a cocked position.
Figure 3:
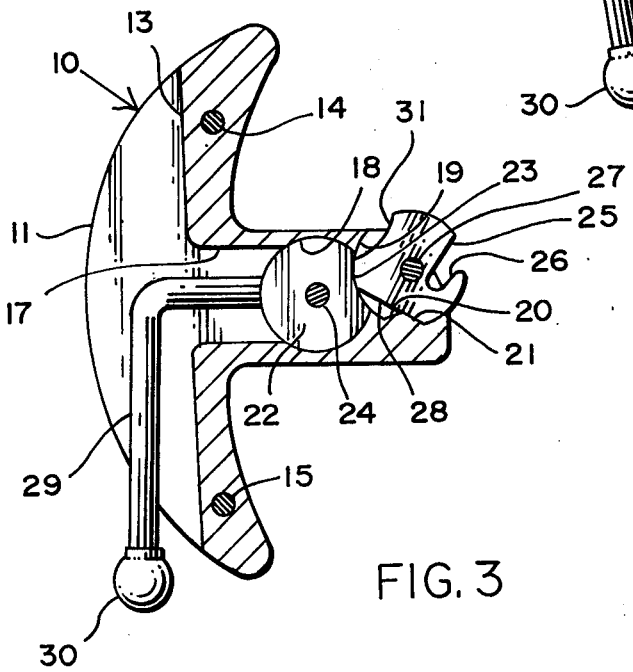
FIG. 3 shows the device in the uncocked or released position.

Referring to the drawing by characters of reference, FIGS. 1–3 illustrate a bowstring release device 10.

The body 11 is provided with a handle to fit the user's hand and is provided with several cavities to contain the various parts of the mechanism. The cavity 19 contains the holding member 25 which rotates on pivot pin 27. The cavity 18 contains the locking member 22 which rotates on pivot pin 24. The cavity 17 provides space for movement of the trigger arm 29. The stop face 20 is provided to limit the rotation of the holding member 25 when in a cocked position and the stop face 21 is provided to limit the rotation of the holding member 25 when in an uncocked position. The radius cut 23 in the locking member 22 is provided for clearance of the periphery of the holding member 25 and the radius cut 31 in the holding member 25 is provided for entry of the periphery of the locking member 22 when the device is in a cocked position. The flat surface 28 is provided to limit the rotation of the holding member 25 when coming against the stop face 20 in a cocked position and when against the stop face 21 in the uncocked position. The notch 26 in the holding member 25 is provided for receiving and holding a bowstring. The cover 12 is attached to the body 11 by the two screws 16 which fit into the holes 14 and 15. The ball 30 is provided for gripping by the finger of the user. The slot 13 in the body 11 provides clearance for movement of the trigger arm 29.

OPERATION OF THE DEVICE

To attach the device to a bowstring the user must place the mechanism in a cocked position which is done by rotating the holding member 25 counterclockwise until the flat 28 comes against the stop face 20. The locking member 22 is then rotated by pushing forward on the ball 30 until the outer periphery of the locking member 22 enters the radius cut 31 of the holding member 25. Holding the device in his hand the user now places the notch 26 of the holding member 25 around a bowstring and draws the bowstring back. To release a bowstring, the user presses on the ball 30 which moves the trigger arm 29 to the rear and rotates the locking member 22 until the periphery of the locking member 22 emerges from the radius cut 31 of the holding member 25 which now allows the holding member 25 to rotate. As the holding member 25 starts to rotate it' periphery then enters the radius cut 23 in the locking member 22. The surface of the radius cut 23 acting against the rotation of the holding member 25 as the holding member 25 moves to an uncocked position, and a bowstring is released.

Although but a few embodiments of the invention have been shown and described, it will be apparent to those skilled in the art that various changes and modifications may be made therein without departing from the spirit of the invention or from the scope of the appended claims.

What is claimed is:

1. A bowstring holding and release mechanism comprising a holding and release means for releaseably engaging a bowstring, said holding and release means comprising a rotating holding and release means for movement between a cocked and an uncocked position for holding and releasing a bowstring, respectively, a rotating locking means for locking said holding and release means in a cocked position when said locking means is in a cocked position, means on the periphery of said holding and release means, said last mentioned means bearing against a portion of the periphery of said locking means and preventing the rotation of said holding and release means when said holding and release means and said locking means are in a cocked position, trigger means unitary with said locking means for engagement and actuation by the hand of an archer means on the periphery of said locking means for releasing said holding and release means to permit rotation thereof when said locking means is moved to an uncocked position in response to said hand actuation, said locking means remaining in contact with said holding and release means with said means on the periphery said locking means acting against the rotation of said holding and release means when the holding and release means is in an uncocked position, whereby when said holding and release means and said locking means are in cocked positions and said holding and release means is connected to a tense bowstring, and said locking means is moved to an uncocked position, said holding and release means moves to an uncocked position under tension of a released bowstring.

2. The structure as recited in claim 1 wherein: said means mounted on said holding means is concave and conforms to the outer periphery of said locking means.

3. The structure as recited in claim 1 wherein: said means in said locking means is concave and conforms to the outer periphery of said holding and release means.

4. The structure as recited in claim 1 taken in combination with handle means shaped to fit the user's hand.

* * * * *